United States Patent [19]

Iizuka et al.

[11] 4,344,561

[45] Aug. 17, 1982

[54] CENTRIFUGAL TYPE OIL FILTER FOR AN ENGINE

[75] Inventors: Yoshitoku Iizuka, Urawa; Kiyokazu Ohkubo, Wako, both of Japan

[73] Assignee: Honda Giken Kogyo Kabushiki Kaisha, Tokyo, Japan

[21] Appl. No.: 177,376

[22] Filed: Aug. 12, 1980

[30] Foreign Application Priority Data

| | | | |
|---|---|---|---|
| Aug. 15, 1979 | [JP] | Japan | 54-112219[U] |
| Aug. 17, 1979 | [JP] | Japan | 54-113215[U] |
| Aug. 21, 1979 | [JP] | Japan | 54-115113[U] |
| Aug. 24, 1979 | [JP] | Japan | 54-116604[U] |

[51] Int. Cl.[3] ..... B04B 9/08

[52] U.S. Cl. ..... 233/24; 192/105 CD; 192/113 B

[58] Field of Search ..... 233/23 R, 23 A, 24, 233/25; 192/105 CD, 48.3, 48.4, 45, 48.92, 113, 113 B

[56] References Cited

U.S. PATENT DOCUMENTS

| | | | |
|---|---|---|---|
| 2,230,293 | 2/1941 | Harris | 192/48.4 |
| 2,476,377 | 7/1949 | Clair | 233/23 R |
| 3,429,411 | 2/1969 | Hazzard | 192/105 CD |
| 3,804,222 | 4/1974 | Reams | 192/105 CD |
| 4,253,953 | 3/1981 | Libertini | 233/24 |

*Primary Examiner*—Robert W. Jenkins
*Attorney, Agent, or Firm*—Armstrong, Nikaido, Marmelstein & Kubovcik

[57] ABSTRACT

A centrifugal type oil filter for the engine, which is simple in construction, comprising a crank shaft of the engine, a clutch having a driving plate mounted on the crank shaft so that it may be rotated with the crank shaft, and oil passage axially formed within the crank shaft, and a bowl-shaped filter cap secured to one side of the driving plate to interiorly define, in cooperation with the side of the driving plate, a centrifugal separating chamber disposed in the midst of the oil passage. The clutch is in the form of a centrifugal clutch comprising clutch shoes radially expandably connected to the driving plate by oscillating links and a clutch drum disposed radially outwardly of the clutch shoes and adapted to be frictionally connected to the clutch shoes when the latter are expanded under centrifugal force. A resilient member is interposed between the clutch shoes and the filter cap to restrain the lateral oscillation of the clutch shoes.

16 Claims, 4 Drawing Figures

CENTRIFUGAL TYPE OIL FILTER FOR AN ENGINE

BACKGROUND OF THE INVENTION

The present invention relates to a centrifugal type oil filter for an engine disposed in an oil passage of the engine is centrifugally separate foreign substances such as chips from lubricating oil which flows through the oil passage.

SUMMARY OF THE INVENTION

It is an object of the present invention to provide the aforesaid centrifugal type oil filter which is simple in construction and inexpensive, wherein a filter cap is secured to a driving plate of a clutch provided on a crank shaft of the engine to form a centrifugal separating chamber.

It is a further object of the present invention to provide a centrifugal type oil filter which is simple in construction, wherein the staying time of lubricating oil within the centrifugal separating chamber defined by the driving plate of the clutch and the filter cap may be extended to obtain a high rate of purification.

It is another object of the present invention to provide the aforesaid centrifugal type oil filter which in delivery of lubricating oil between an oil passage in a fixed wall of the engine and an oil passage in a crank shaft having one end supporting on said wall, can suppress leakage at the joint portion of lubricating oil to the utmost thereby providing an efficient delivery of lubricating oil.

It is a still another object of the present invention to provide the aforesaid centrifugal type oil filter having a centrifugal type clutch comprising a driving plate secured to a crank shaft, a clutch drum rotatably mounted on the crank shaft and connected to an output gear, and clutch shoes connected to the driving plate so that when the clutch shoes receive a centrifugal force in excess of a predetermined value, they are radially expanded against return spring into frictional connection with the clutch drum to automatically transmit a torque from the driving plate to the clutch drum, whereby even if the return spring is subjected to an excessive centrifugal force when the driving plate is rotated at high speeds, it is neither damaged nor disengaged from grooves in which the spring is accommodated.

It is another object of the present invention to bring every part of linings secured to the clutch shoes of the aforesaid centrifugal type clutch into substantially uniform pressure contact with the clutch drum at the time of actuation of the clutch thereby obtaining a state of good frictional connection between the clutch shoes and the clutch drum and substantially uniform wearing at every part of the lining to considerably prolong the service life thereof.

It is another object of the present invention to prevent lateral vibration of wedging members of a one-way clutch which acts to directly connect the crank shaft and the output gear when a counter load is exerted on the output gear, and to provide position lubrication for the one-way clutch and movable parts of the centrifugal clutch to stabilize the operation thereof.

The above and other objects, features and advantages of the invention will become apparent from the following detailed description of the invention when taken in conjunction with the accompanying drawings which illustrate a presently preferred embodiment of the invention.

DETAILED DESCRIPTION OF THE INVENTION

Figure 1:
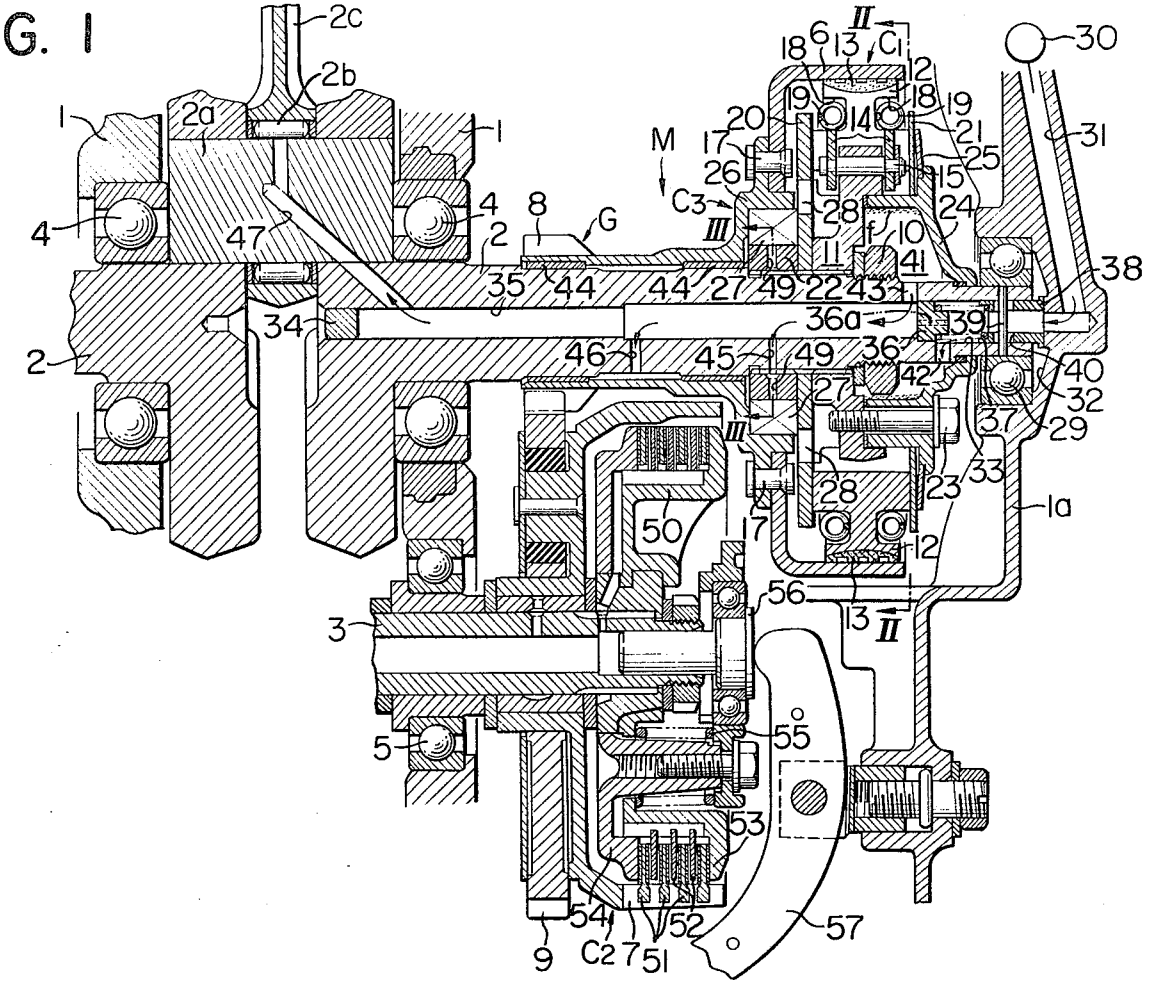
FIG. 1 is a longitudinal sectional view of a transmission device provided with a centrifugal type oil filter for an engine in accordance with a first embodiment of the present invention.

A first embodiment of the present invention will be explained hereinafter with reference to FIGS. 1 to 3. A crank case 1 of the engine has a crank shaft 2 and a variable speed input shaft 3 supported thereon parallel to each other through bearings 4 and 5 between which is disposed a transmission device M. A crank pin 2*a* of the crank shaft 2 supports a large end portion of a connecting rod 2*c* through a needle bearing 2*b*.

The transmission device M comprises a starting clutch $C_1$ provided on the end of the crank shaft 2, a variable speed clutch $C_2$ provided on the end of the variable speed input shaft 3, and a reduction gear train G composed of a small diameter output gear 8 and a large diameter input gear 9 respectively connected to a clutch drum 6 as an output member of the starting clutch $C_1$ and a clutch outer member 7 as an input member of the variable speed clutch $C_2$, wherein each of said members are arranged close to one another so that the variable speed clutch $C_2$ is interposed between the starting clutch $C_1$ and the reduction gear train G. With such an arrangement, the transmission device M can be compactified.

In the following, every part of the transmission device M will be specifically described.

First, the starting clutch $C_1$, which is of the centrifugal type, comprises a driving plate 11 spline-fitted into the crank shaft 2 and secured thereto by means of a nut 10, a plurality (three in the illustrated embodiment) of clutch shoes 12 disposed in the outer periphery of the driving plate 11, and the clutch drum 6 for encircling thereof, the clutch shoes 12 having a lining 13 joined to the outer peripheral surface thereof for frictional engagement with the inner peripheral surface of the clutch drum 6.

Figure 2:
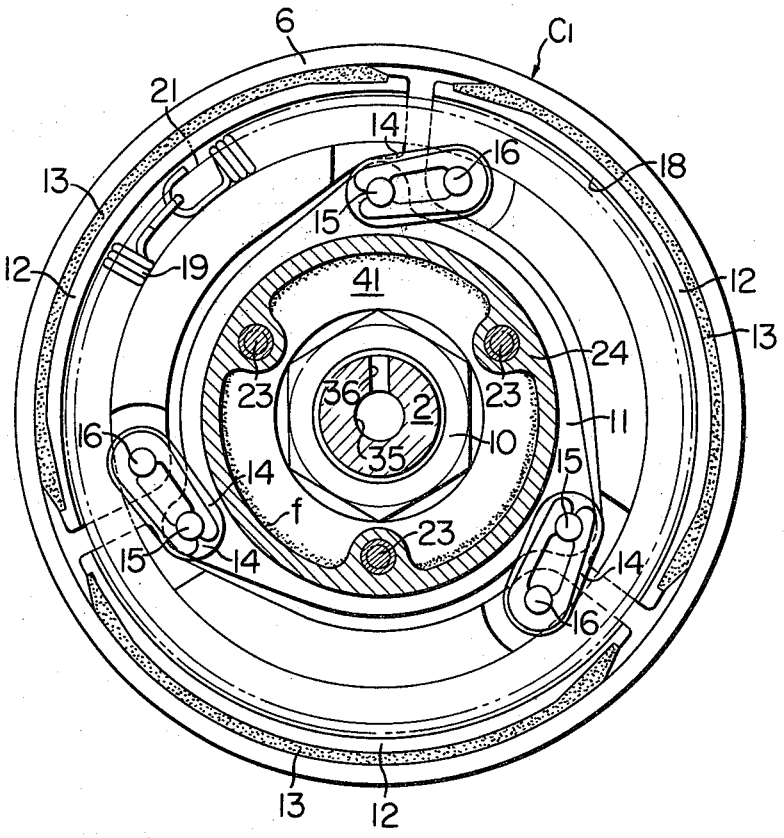
FIG. 2 is a sectional view taken along line II—II of FIG. 1.
Figure 3:
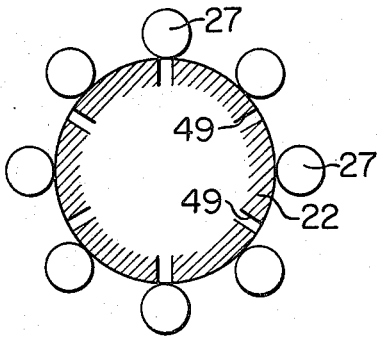
FIG. 3 is a sectional view taken along line III—III of FIG. 1.

As shown in FIG. 2, the clutch shoes 12 have their base ends connected to the driving plate 11 through a pair of left and right links 14 and pivots 15 and 16 located at both ends thereof for expansion motion in an radial direction. The aforesaid clutch drum 6 is connected to the output gear 8 through a rivet 17.

Spring accommodation grooves 18 in the form of an annulus as a whole are respectively formed in both left and right sides of the plurality of clutch shoes 12 in a coaxial relation with the crank shaft 2, said grooves 18 each accommodating therein a return spring 19 in the form of an annular coiled spring. A predetermined set load is applied to these return springs 19 in a contraction direction to thereby urge all the clutch shoes 12 in a contraction direction radially inwards.

In order to prevent disengagement of the return springs 19 from grooves 18, a pair of left and right side plates 20 and 21 for substantially closing openings of the grooves 18 are disposed adjacent to both sides of the clutch shoes 12, one side plate 20 being clamped between a clutch inner member 22 of a one-way clutch $C_3$ to be described later and the driving plate 11, the other side plate 21 being carried on a filter cap 24 secured to a side surface of the driving plate 11 by means of a bolt 23 and biased by means of a belleville spring 25 towards the opposite side plate 20. Thus, both the side plates 20 and 21 cooperate to resiliently hold all the clutch shoes 12 therebetween and also have a function to restrain their axial movement or vibration.

When a rotational speed of the crank shaft 2 is less than a predetermined value, the set load of the return springs 19, that is, a predetermined contraction force, overcomes a centrifugal force of the clutch shoes 12, which rotate along with the driving plate 11, to hold the clutch shoes 12 in their contraction state and as a result, the clutch shoes 12 are disengaged from the inner peripheral surface of the clutch drum 6. At this time, the clutch $C_1$ is in a released state and therefore the crank shaft idles, thus transmitting no turning torque to the output gear 8.

On the other hand, when a rotational speed of the crank shaft 2 increases to a level above the predetermined value, the centrifugal force of the clutch shoes 12 exceeds the set load of the return springs 19 so that the clutch shoes 12 start to expand to bring the linings 13 into contact with the inner peripheral surface of the clutch drum 6 with a contact pressure increasing as the rotational speed of the crank shaft 2 rises, resulting in frictional connection between the clutch shoes 12 and the clutch drum 6. Thus, the turning torque of the crank shaft 2 is transmitted from the starting clutch $C_1$ to the reduction gear train G in accordance with the rotational speed of the crank shaft, to the variable speed input shaft 3 through the variable speed clutch $C_2$ and thence to driving wheels through variable speed gears not shown, thus providing smooth starting of the vehicle.

It should be particularly noted that upon the outward expansion of the clutch shoes 12, the oscillating links 14 are outwardly oscillated about pivots 15 whereby the base ends of the clutch shoes 12 are also displaced outwardly similarly to the free ends thereof, and consequently, every part of the frictional surface of the linings 13 of the clutch shoes 12 can be uniformly placed in engagement with the inner peripheral surface of the clutch drum 6.

If the rotational speed of the crank shaft 2 further increases to enlarge the centrifugal force acting on the return springs 19 to a value greater than the contraction force thereof so that the return springs 19 are stretched to expand in a radial direction, the springs immediately come to contact with the outer peripheral wall surfaces of the grooves 18 to restrain further expansion thereof. Also, if at this time, the return springs 19 assume their floating state so that the springs are moved towards the openings of the grooves 18, such movement of the springs is immediately restricted by the side plates 20 and 21 to prevent the springs from being disengaged from the grooves 18.

Next, the aforementioned one-way clutch $C_3$ will be described. The one-way clutch is of the conventional construction which comprises a clutch inner member 22 splined to the crank shaft 2, a clutch outer member 26 formed integral with the output gear 8, and wedging members 27 such as rollers for unidirectionally transmitting a turning torque from the clutch outer member 26 to the clutch inner member 22. The one-way clutch operates such that only when a counter load is exerted on the output gear 8, the clutch inner and outer members 22, 26 are placed into driving connection with each other through the wedging members 27 to transmit the counter load to the crank shaft 2. Thus, even when the centrifugal clutch $C_1$ is released, the engine brake action may be obtained.

The side plate 20 is held between the driving plate 11 of the centrifugal clutch $C_1$ and the clutch inner member 22 of the one-way clutch $C_3$ to thereby come into contact with one end of the wedging members 27 to restrict axial movement thereof. The side plate 20 is annually formed with a plurality of holes 28 to provide communication between the inner peripheral surface of the clutch outer member 26 and the internal portion of the clutch shoes 12.

A crank case side cover 1*a* for supporting one end of the crank shaft 2 through a ball bearing 29 is formed with an oil passage 31 in communication with a lubrication pump 30. The oil passage 31 is open to an inner end of a housing 32 for the bearing 29 formed in the side cover 1*a*.

The crank shaft 2 is axially provided with a relatively short, large-diameter upstream oil passage 33 opening at the one end thereof and a small diameter downstream oil passage 35 extending from the upstream oil passage 33 to the other end of the crank shaft 2 at which it is closed by a blind plug 34, the upstream oil passage 33 receiving therein, from its inner part, a partitioning plug 36, a coiled spring 37 and an oil delivery cylinder 38 in this order, the partitioning plug 36 being in abutment with a stepped portion at a boundary between both the oil passages 33 and 35 to define these passages on the opposite sides thereof. The oil delivery cylinder 38 can be slidably moved back and forth along the inner peripheral surface of the upstream oil passage 33 and is urged against the inner end surface of the bearing housing 32 by the force of the coiled spring 37, the oil delivery cylinder 38 having a hollow interior through which the oil passage 31 of the side cover 1*a* is brought into communication with the oil passages 33 and 35 of the crank shaft 2. The oil delivery cylinder 38 is connected to the crank shaft 2 by means of a connecting pin 39 so that the oil delivery cylinder 38 may be rotated with the crank shaft 2, but a through hole 40 for the connecting pin 39 formed in the side wall of the oil delivery cylinder 38 is in the form of a slot which extends axially of the oil delivery cylinder 38 so that the lateral sliding movement of the oil delivery cylinder 38 may not be impaired by the connecting pin 39.

Now, the centrifugal type filter in accordance with the present invention is composed of the aforesaid driving plate 11 and a bowl-shaped filter cap 24 secured to the side surface of the driving plate by means of a bolt 23 with the crank shaft 2 extending therethrough, the filter cap 24 and driving plate cooperating to form a centrifugal separating chamber 41. An inlet port 42 and an outlet port 43 are formed in the crank shaft 2 so as to bring the centrifugal separating chamber 41 into communication with the oil passages 33 and 35 within the crank shaft 2, these ports 42 and 43 extending radially of the crank shaft 2 and being deviated from each other on the circumference of the crank shaft 2, the angle of relative deviation being preferably approximately 180° as shown in the embodiment.

The crank shaft 2 has oil ports 45, 46 and 47 formed therethrough to bring the downstream oil passage 35 into communication with the one-way clutch $C_3$, the bearing 44 of the output gear 8 and the needle bearing 2*b* of the connecting rod 2*c*, respectively. The downstream oil passage 35 is placed in communication with the inner and outer peripheral surfaces of the clutch inner member 22 and the inner peripheral surface of the clutch outer member 26 through the port 45 and plurality of ports 49 extending in a radial direction of the clutch inner member 22. Since the oil ports 49 have their pitch different from that of a plurality of wedging members 27 as shown in FIG. 3, all the oil ports 49 are not simultaneously blocked by the wedging members 27.

Thus, during the operation of the engine, lubricating oil fed under pressure from the lubrication pump 30 is delivered from the oil passage 31 of the side cover 1*a* to the upstream oil passage 33 of the crank shaft 2 through the oil delivery cylinder 38, and flows into the centrifugal separating chamber 41 from the inlet port 42.

Incidentally, the inlet port 42 and outlet port 43 opening to the separating chamber 41 extend radially of the crank shaft 2 and are deviated from each other on the circumference of the crank shaft 2 as previously mentioned, and therefore, lubricating oil introduced from the inlet port 42 into the separating chamber 41 is largely by-passed as indicated by the arrow within the separating chamber 41 before it reaches the outlet port 43, thereby increasing the staying time of oil within the separating chamber 41, during which lubricating oil is subjected to sufficient turning force from the driving plate 11 and the filter cap 24 to make it possible to positively separate foreign substances f such as chips from the coil. The thus purified lubricating oil is moved from the outlet port 43 to the downstream oil passage 35, and the lubricating oil partly flows into the one-way clutch $C_3$ via the oil ports 45 and 49 to lubricate the sliding surface thereof, then flowing into the internal portions of the clutch shoes 12 passing through the through holes 28 of the side plate 20 to lubricate the sliding surfaces between the clutch shoes 12 and the side plates 20 and 21 and the movable portions such as the links 14 and the pivots 15 and 16. Also, the other part of lubricating oil flowing through the downstream oil passage 35 is supplied to the bearings 44 of the output gear 8 via the oil port 46 and to the needle bearing 2*b* of the connecting rod 2*c* via the coil port 47.

Since the rotating crank shaft 2 is supported at one end by the bearing 29 to restrain oscillations thereof during the rotation thereof, the contact state of the oil delivery cylinder 38 with the inner end of the bearing housing 32 is not varied, that is, the oil delivery cylinder 38 is not inclined to minimize an amount of leakage of lubricating oil from the contact portion with the inner end of the bearing housing 32. It will be noted that the bearing housing 32 is filled with leaked oil to lubricate the bearing 29.

It is further noted that the partitioning plug 36 is sometimes formed with a small hole 36*a* to provide a direct communication between both the oil passages 33 and 35 as indicated by the chain dotted line. With this arrangement, lubricating oil is partly directly moved from the upstream oil passage 33 into the downstream oil passage 35 without passing through the separating chamber 41, and hence, a shortage of lubricating oil in the downstream oil passage 35 can be compensated particularly at the initial stage of operation of the engine.

The variable speed clutch $C_2$, which is of the multiple friction plate type, comprises a clutch inner member 50 as an output member splined to the variable speed input shaft 3, the clutch outer member 7 encircling the clutch inner member, a plurality of driving friction plates 51 splined slidably along the inner periphery of the clutch outer member, and a plurality of driven friction plates 52 alternately placed one over another and splined slidably along the outer periphery of the clutch inner member 50, the group of these friction plates 51,52 having at one side a pressure receiving plate 53 integral with the clutch inner member 50 disposed adjacent thereto, and at the other side an axially retractable pressing plate 54 disposed adjacent thereto, the pressing plate 54 being biased by means of a clutch spring 55 towards the pressure receiving plate 53. The pressing plate 54 is further provided with a release member 56 slidably supported in the variable speed input shaft 3, and a clutch lever 57 is connected to the release member 56.

Thus, normally, the pressure receiving plate 53 and the pressing plate 54 cooperate by the force of the clutch spring 55 to press both the friction plates 51 and 52 therebetween into frictional connection each other, and hence, the variable speed clutch $C_2$ is maintained in connection state.

When the clutch lever 57 is operated to retract the pressing plate 54 against the force of the clutch spring 55 through the release member 56, friction plates 51 and 52 are disengaged from each other so that the clutch $C_2$ assumes its release state, at which time, the variable speed gear is shifted.

Figure 4:
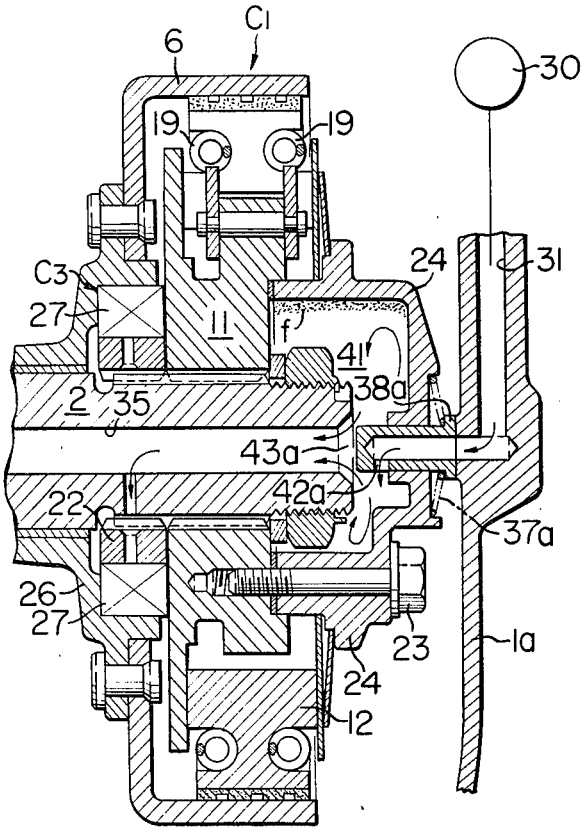
FIG. 4 is a longitudinal sectional view of a centrifugal type oil filter for the engine in accordance with a second embodiment of the present invention.

FIG. 4 shows a second embodiment of the centrifugal type oil filter in accordance with the present invention, which is similar in construction to that of the aforementioned first embodiment with the exception of an oil delivery mechanism for delivering lubricating oil from the oil passage 31 within the side cover 1*a* of the crank case to the centrifugal separating chamber 41 within the filter cap 24. In FIG. 4, like references designate like parts corresponding to those of the first embodiment. In this embodiment, the oil delivery cylinder 38*a* slidably extends through the central portion of the end wall of the filter cap 24 and is urged under the action of spring 37*a* against the internal surface of the side cover 1*a* to which oil passage 31 opens. The oil delivery cylinder 38*a* has its inner end closed, and an inlet 42*a* opening to the centrifugal separating chamber 41 is directed radially outwardly.

One end of the crank shaft 2 terminates within the centrifugal separating chamber 41; an outlet 43*a* of the oil passage 35 within the crank shaft 2 is open to the central portion of the centrifugal separating chamber 41; and the closed inner end of the oil delivery cylinder 38*a* is disposed in close proximity to the outlet 43*a* so as to suitably throttle the opening thereof, thus preventing a direct flow of lubricating oil from the inlet 42*a* to the outlet 43*a*.

Thus, during the operation of the engine, lubricating oil fed under pressure from the lubrication pump 30 is delivered from the oil passage 31 of the side cover 1*a* to the centrifugal separating chamber 41 through the oil delivery cylinder 38*a*, and the oil is by-passed as indicated by the arrow within the centrifugal separating chamber, during which lubricating oil is subjected to a turning force from the driving plate 11 and the filter cap 24 to centrifugally separate foreign substances f from the oil, after which oil is moved into the oil passage 35 of the crank shaft 2.

When the bolt 23 is removed to remove the filter cap 24 from the driving plate 11, the foreign substances f adhered to the internal surface thereof can be cleaned.

As described above, in accordance with the present invention, the filter cap is secured to one side of the driving plate of the clutch mounted on the crank shaft so as to close the open end thereof, the interior of the cap being formed into a centrifugal separating chamber disposed in the midst of the oil passage of the engine. With this arrangement, the driving plate of the clutch forms a part of the filter rotatably driven by the crank shaft to simplify the construction thereof, thus achieving a considerable cost reduction.

Further, the crank shaft axially formed with a flow passage has a filter body secured thereto, said filter body having a centrifugal separating chamber, said flow passage being divided into an upstream flow passage and a downstream flow passage by means of a partitioning member, and an inlet port from the upstream flow passage to the centrifugal separating chamber and an outlet port from the centrifugal separating chamber to the downstream flow passage are deviated from each other on the circumference of the crank shaft. With this arrangement, the fluid can stay within the separating chamber for a long period of time until it reaches the outlet port from the inlet port while being subjected to a centrifugal force for a relatively long period of time, as a consequence of which the rate of purification may be materially increased. Moreover, since a short-circuit preventive plate particularly need not be provided between the inlet hole and the outlet hole, the construction is simple.

In addition, the fixed wall in the form of a crank case is formed with a bearing housing and a fixed oil passage opening to the inner end of the housing; one end of the crank shaft is supported by a bearing accommodated in the bearing housing to prevent oscillation thereof, and an oil delivery cylinder normally urged against the inner end of the bearing housing by the force of the spring is fitted in a rotational oil passage formed in the crank shaft and opening to the end thereof so that the fixed oil passage is brought into communication with the rotational oil passage through the oil delivery cylinder. With this arrangement, the contact state of the oil delivery cylinder with respect to the inner end of the bearing housing is always maintained properly during the rotation of the crank shaft, and thus, the effective delivery of lubricating oil from the fixed oil passage to the rotational oil passage, and vice versa may be carried out.

Furthermore, lubricating oil leaking from the oil delivery cylinder serves to lubricate the bearing which supports one end of the crank shaft for efficient and economical use.

The return springs formed of annular coil springs are accommodated in the annular grooves formed in the opposite sides of clutch shoes so that the return springs may be restricted in their extension to a predetermined value at the outer peripheral wall of the grooves. As a result, the return springs may be prevented from being damaged even if an excessive centrifugal force is applied thereto, thus manifesting an extremely high durability.

The side plates serve to substantially close the openings of the grooves whereby the return springs can be securely prevented from being disengaged from grooves even if the spring should assume a floating state.

Also, since the return spring are merely inserted into the grooves, the device can be readily assembled, has a simple construction and can be produced at low cost.

In the centrigual type clutch, the base end of the clutch shoes is connected to the driving plate through the oscillating links and the pivot on both ends thereof, and therefore, the oscillating links permit radially outward movements of the base end of the clutch shoes similar to the free end thereof. Further, every part of the lining when expanded due to the centrifugal force may be approximately uniformly brought into pressure contact with the clutch drum to obtain a good frictional connection. In addition, since the lining is worn substantially uniformly in every part thereof, the whole lining may be effectively used to considerably prolong the service life.

The motion of the clutch shoes and the oscillating link is always smoothly carried out because they are rotated about the pivots, and thus, the time of automatically opening and closing the clutch can be stabilized.

Since a common side plate is interposed between the wedging member of the one-way clutch and the clutch shoe of the centrifugal clutch to restrain axial movement thereof, it is possible to prevent lateral vibrations of the wedging members and the clutch shoe by use of a minimum number of components, thus simplifying the construction thereof.

The clutch inner member of the one-way clutch has oil ports to provide communication between the outer peripheral surface thereof and the lubrication passage within the crank shaft, and the side plate has through-holes to provide communication between the inner peripheral surface of the clutch outer member of the one-way clutch and the internal portion of the clutch shoe. With this arrangement, the movable parts of the centrifugal clutch may be positively lubricated by the oil which has been used to lubricate the one-way clutch without being impaired any way by the side plate, whereby, in combination with the absense of lateral vibrations of the wedging member and clutch shoes, each of the clutches may always be operated in a stable manner, and the construction of lubricating oil passages is also simplified.

What is claimed is:

1. In combination with an engine transmission system comprising a crank shaft of the engine having an oil passage axially formed therein; a first clutch having a driving plate concentrically mounted on the crank shaft for rotation therewith; and transmission means operatively associated with said first clutch to transfer power from said crank shaft to wheels of a vehicle; a centrifugal type oil filter comprising a filter cap concentrically secured to one side of said driving plate interiorly defining therewith an annular centrifugal separating chamber in communication with said oil passage.

2. A centrifugal type oil filter for an engine according to claim 1, wherein said first clutch is a centrifugal clutch which comprises clutch shoes connected with said driving plate for rotation therewith and for radial expansion relative thereto, and a clutch drum disposed radially outwardly of said clutch shoes, said clutch shoes being adapted to expand radially outward under centrifugal effect so that they are placed into frictional engagement with said clutch drum, and wherein a resilient member is interposed between said clutch shoes and said filter cap to restrain lateral vibration of said clutch shoes.

3. A centrifugal type oil filter for an engine according to claim 2, said first clutch further comprising a pair of annular grooves formed in said clutch shoes at the opposite sides thereof and being open sidewise, and a pair of return spring accommodated in said grooves to urge said clutch shoes in a contraction direction.

4. A centrifugal type oil filter for an engine according to claim 3, said first clutch further comprising a pair of side plates disposed adjacent to the opposite sides of said clutch shoes for substantially closing said grooves.

5. A centrifugal type oil filter for an engine according to claim 2, 3 or 4, said first clutch further comprising a plurality of links each pivoted at one end to said driving plate and at the other end to said respective clutch shoes.

6. A centrifugal type oil filter for an engine according to claim 2, said transmission means comprising an output gear rotatably mounted on said crank shaft and connected with said clutch drum.

7. A centrifugal type oil filter for an engine according to claim 6, said transmission means further comprising a one-way clutch interposed between said crank shaft and said output gear for unidirectionally transmitting power from the former to the latter when said output gear is subjected to an excessive load.

8. A centrifugal type oil filter for an engine according to claim 7, wherein said one-way clutch comprises a clutch inner member secured to said crank shaft; a clutch outer member arranged radially outwardly of said clutch inner member and connected to said output gear; and a plurality of wedging members disposed between said clutch inner and outer members.

9. A centrifugal type oil filter for an engine according to claim 8, wherein said clutch inner member of said one-way clutch has oil port means formed therethrough for providing communication between the outer peripheral surface of said clutch inner and said oil passage in said crank shaft.

10. A centrifugal type oil filter for an engine according to claim 9, further comprising a side plate interposed between said one-way clutch and said clutch shoes has through hole means for providing communication between said inner peripheral surface of the clutch outer member and the internal sides of said clutch shoes.

11. A centrifugal type oil filter for an engine according to claim 9, wherein said oil port means comprises a plurality of oil ports radially extending through said clutch inner member.

12. A centrifugal type oil filter for an engine according to claim 11, wherein at least one of said plurality of oil ports is normally arranged to be displaced from said wedging members.

13. A centrifugal type oil filter according to claim 1, wherein said oil passage is divided into an upstream passage and a downstream passage, said centrifugal separating chamber being in communication with said upstream and downstream passages respectively through an inlet port and an outlet port which are formed through said crankshaft.

14. A centrifugal type oil filter for an engine according to claim 13, wherein said inlet port and said outlet port are arranged to be deviated from each other circumferentially of said crank shaft.

15. A centrifugal type oil filter for an engine according to claim 14, wherein said inlet and outlet ports are arranged in diametrically opposite relation with each other.

16. A centrifugal type oil filter for an engine according to any one of claims 1, 2, 13, 14 or 15, further comprising a fixed wall; a bearing housing formed in said fixed wall; a fixed oil passage opening at an inner end of said housing; a bearing accommodated within said housing and rotatably supporting one end of said crank shaft; said oil passage in said crank shaft opening at said one end of said crank shaft; and an oil delivery cylinder fitted in said oil passage of said crank shaft and normally urged against the inner end of said bearing housing by a force of a spring to provide a communication between said fixed oil passage and said oil passage.

* * * * *